US008095034B2

(12) United States Patent
Ito

(10) Patent No.: US 8,095,034 B2
(45) Date of Patent: Jan. 10, 2012

(54) IMAGE INPUT/OUTPUT APPARATUS AND OPERATING DEVICE

(75) Inventor: Tomoya Ito, Nagoya (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 535 days.

(21) Appl. No.: 12/393,713

(22) Filed: Feb. 26, 2009

(65) Prior Publication Data

US 2009/0220268 A1 Sep. 3, 2009

(30) Foreign Application Priority Data

Feb. 28, 2008 (JP) ..... 2008-048599

(51) Int. Cl.
*G03G 15/00* (2006.01)

(52) U.S. Cl. ..... 399/107
(58) Field of Classification Search ..... 399/107, 399/110, 116
See application file for complete search history.

(56) References Cited

U.S. PATENT DOCUMENTS

| | | | | |
|---|---|---|---|---|
| 5,661,567 | A | 8/1997 | Maeda et al. | |
| 2005/0117933 | A1* | 6/2005 | Park et al. | 399/107 |
| 2006/0083564 | A1* | 4/2006 | Yazawa et al. | 399/363 |

FOREIGN PATENT DOCUMENTS

| | | |
|---|---|---|
| JP | 07-084499 | 3/1995 |
| JP | 07-092858 | 4/1995 |
| JP | 09-134792 | 5/1997 |
| JP | 11-033170 | 2/1999 |
| JP | 11-121057 | 4/1999 |
| JP | 2000-162944 | 6/2000 |
| JP | 2000-252093 | 9/2000 |
| JP | 2000-284559 | 10/2000 |
| JP | 2000-294943 | 10/2000 |
| JP | 2004-098618 | 4/2004 |

OTHER PUBLICATIONS

Notice of Reasons for Refusal for Japanese patent application No. 2008-048599 dated Feb. 25, 2010.

* cited by examiner

*Primary Examiner* — David Porta
*Assistant Examiner* — Marcus Taningco
(74) *Attorney, Agent, or Firm* — Banner & Witcoff, Ltd.

(57) ABSTRACT

An image input/output apparatus includes an image input/output section, an operation section, a cover member, and an electrostatic eliminating device. The image input/output section can perform at least one of an image input operation and an image output operation. The image input/output section includes a movable member capable of being moved between a first position and a second position, and the electrostatic eliminating device is arranged on the movable member. The operation section includes an electric board, and enables a user to operate the image input/output section. The cover member is detachably mounted to the operation section so as to cover the operation section. The cover member cannot be detached or attached when the movable member is in the first position, and can be detached or attached when the movable member is in the second position.

12 Claims, 17 Drawing Sheets

IMAGE INPUT/OUTPUT APPARATUS AND OPERATING DEVICE

CROSS REFERENCE TO RELATED APPLICATION

The present application claims priority from Japanese Patent Application No. 2008-048599 filed on Feb. 28, 2008. The entire content of this priority application is incorporated herein by reference.

TECHNICAL FIELD

The present disclosure relates to an image input/output apparatus and an operating device.

BACKGROUND

In some printers, a detachable cover member is provided on the operation section. On the cover member, characters representing functions corresponding to the operating switches are written in some language. The cover member can be replaced with another cover member that includes character representation in a language of the user's choice, even after purchase.

When the cover member is detached for replacement, the static electricity on the user may be discharged to an electric board included in the operation section, resulting in damage or malfunction of the electric board.

In view of these circumstances, there has been proposed that an insulating sheet be disposed between an operation panel and the electric board so as to cover the electric board, in order to protect the electric board from static electricity.

However, the insulating sheet arranged to cover the electric board may cause some disadvantages, such as cost increase, printer weight increase or printer size increase.

SUMMARY

According to one aspect of the present invention, an image input/output apparatus includes an image input/output section, an operation section, a cover member, and an electrostatic eliminating device. The image input/output section is configured to perform at least one of an image input operation and an image output operation. The image input/output section includes a movable member capable of being moved between a first position and a second position, and the electrostatic eliminating device is arranged on the movable member. The operation section includes an electric board, and is configured to enable the operation of the image input/output section. The cover member is detachably mounted to the operation section so as to cover the operation section. The cover member cannot be detached or attached when the movable member is in the first position, and can be detached or attached when the movable member is in the second position.

According to another aspect of the present invention, an operating device includes an operation section, a cover member, a first conductive member, and a second conductive member. The operation section has an electric board. The cover member has an insulation property, and is detachably mounted to the operation section so as to cover the operation section. The first conductive member is arranged on an outer edge portion of the cover member, so as to be positioned on a part of the cover member that first has contact with the operation section when the cover member is mounted to the operation section. The second conductive member is arranged on the operation section, so as to be positioned on a part of the operation section that first has contact with the first conductive member when the cover member is mounted to the operation section.

According to another aspect of the present invention, an operating device includes an operation section, a cover member, and an electrostatic eliminating device. The operation section has an electric board and an insulating member configured to support the electric board. The cover member has an insulation property, and is detachably mounted to the operation section so as to cover the operation section. The electrostatic eliminating device is arranged on an outer edge portion of the insulating member.

According to further another aspect of the present invention, an operating device includes an operation section, a cover member, and a wall portion. The operation section has an electric board and an insulting member configured to support the electric board. The cover member is detachably mounted to the operation section so as to cover the operation section. The wall portion has an insulation property, and is arranged on an outer edge portion of the insulating member so as to increase a creepage distance between the cover member and the electric board.

BRIEF DESCRIPTION OF THE DRAWINGS

Illustrative aspects in accordance with the present invention will be described in detail with reference to the following drawings wherein.

DETAILED DESCRIPTION

Illustrative Aspect 1

An illustrative aspect 1 of the present invention will now be explained with reference to FIGS. 1 to 10.

(General Construction of Multifunction Printer)

Figure 1:
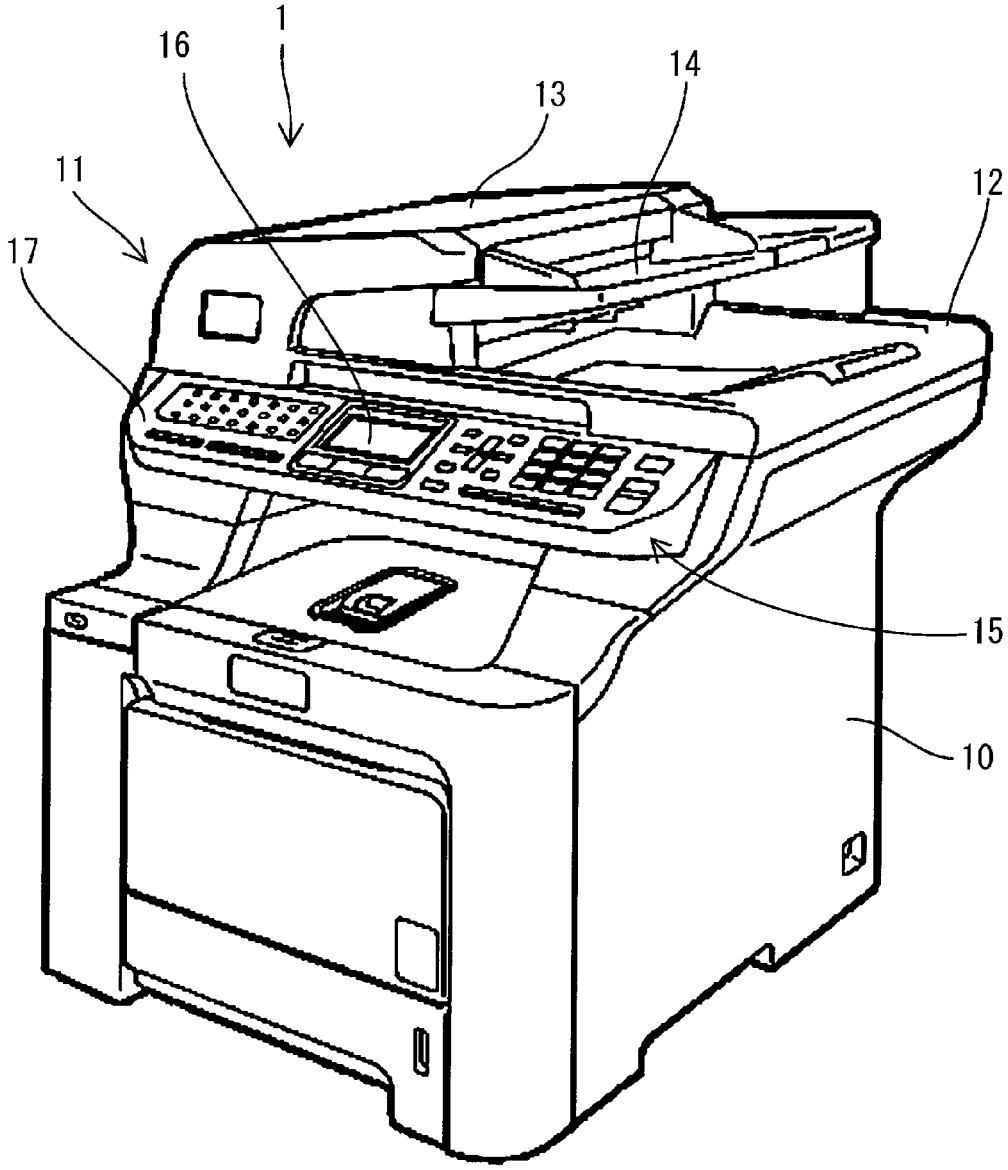
FIG. 1 is a perspective view of a multifunction printer according to an illustrative aspect 1 of the present invention.

FIG. 1 is a perspective view of a multifunction printer 1 (i.e., an example of an image input/output apparatus) having a scan function, a printing function, a copy function, a fax function and the like.

The multifunction printer 1 includes a printer unit 10 having an image forming section 18 (See FIG. 2) for forming an image on a recording medium (such as paper, plastic, and the like). Further, the multifunction printer 1 includes a scanner unit 11 (i.e., an example of an image input/output section) for scanning a document, which is arranged above the printer unit 10.

The scanner unit 11 is a flatbed type, which can input or scan a document (not shown) placed on a document rest (not shown) by an image sensor (not shown) such as a contact image sensor (CIS), so as to generate the image data of the document.

A document cover 12 (i.e., an example of a movable member) is provided above the document rest, so as to be movable between a closed position (or a first position) and an open position (or a second position). The document cover 12 in the closed position covers the document rest. When the document cover 12 is arranged in the open position, the document rest is uncovered.

An ADF 13 (Automatic Document Feeder) integrated with the document cover 12 is provided, which can sequentially feed the documents placed on a paper rest 14 to a scanning position so that the documents are scanned by the image sensor.

An operation section 15 (i.e., an example of an operation section or an operating device) is provided on the upper front portion of the multifunction printer 1, which enables various input operations by a user. Further, a display section 16 having a liquid crystal display is provided on the upper front portion of the multifunction printer 1. The operation section 15 is covered with a cover member 17 as described below.

(Electrical Configuration of Multifunction Printer)

Figure 2:
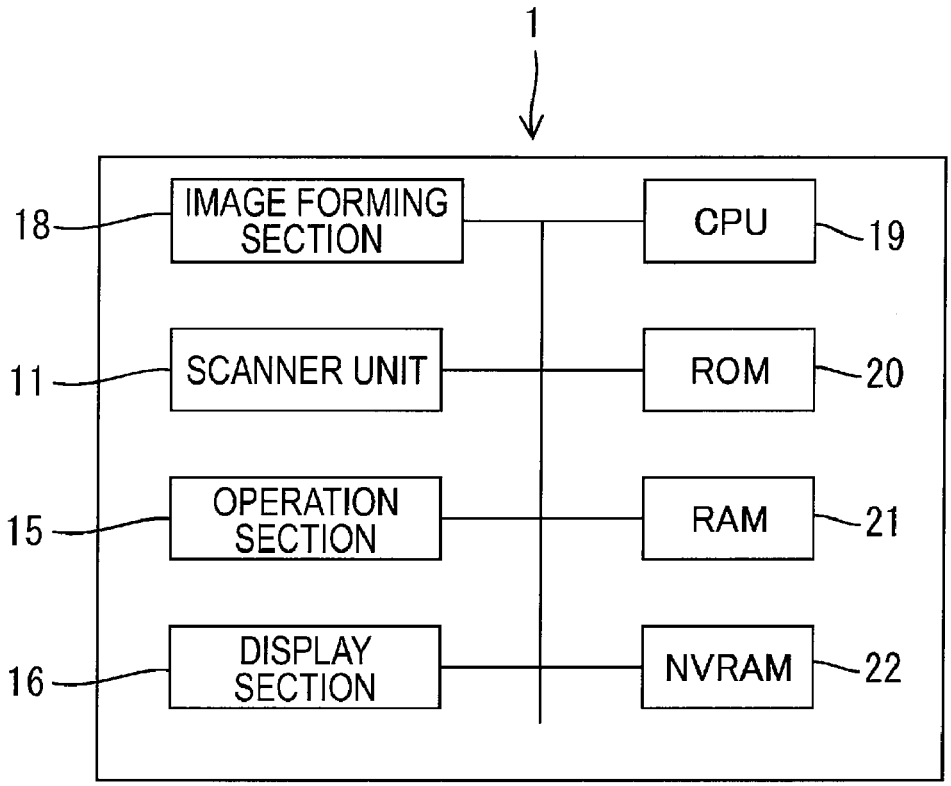
FIG. 2 is a block diagram showing the electrical configuration of the multifunction printer.

FIG. 2 is a block diagram schematically showing the electrical configuration of the multifunction printer 1. In the multifunction printer 1, a CPU 19, a ROM 20, a RAM 21, an NVRAM 22, the scanner unit 11, the image forming section 18, the operation section 15, the display section 16 and the like are electrically connected.

Various programs for controlling the operation of the multifunction printer 1 are stored in the ROM 20. The CPU 19 controls the various sections of the multifunction printer 1 based on the programs retrieved from the ROM 20, while storing the processing results in the RAM 21 and/or the NVRAM 22.

The image forming section 18 includes a conveyor mechanism for conveying a recording medium from a paper cassette. The image forming section 18 can output or form an image on the recording medium based on image data by a laser method, an inkjet method or the like.

(General Construction of Operation Section)

Figure 3:
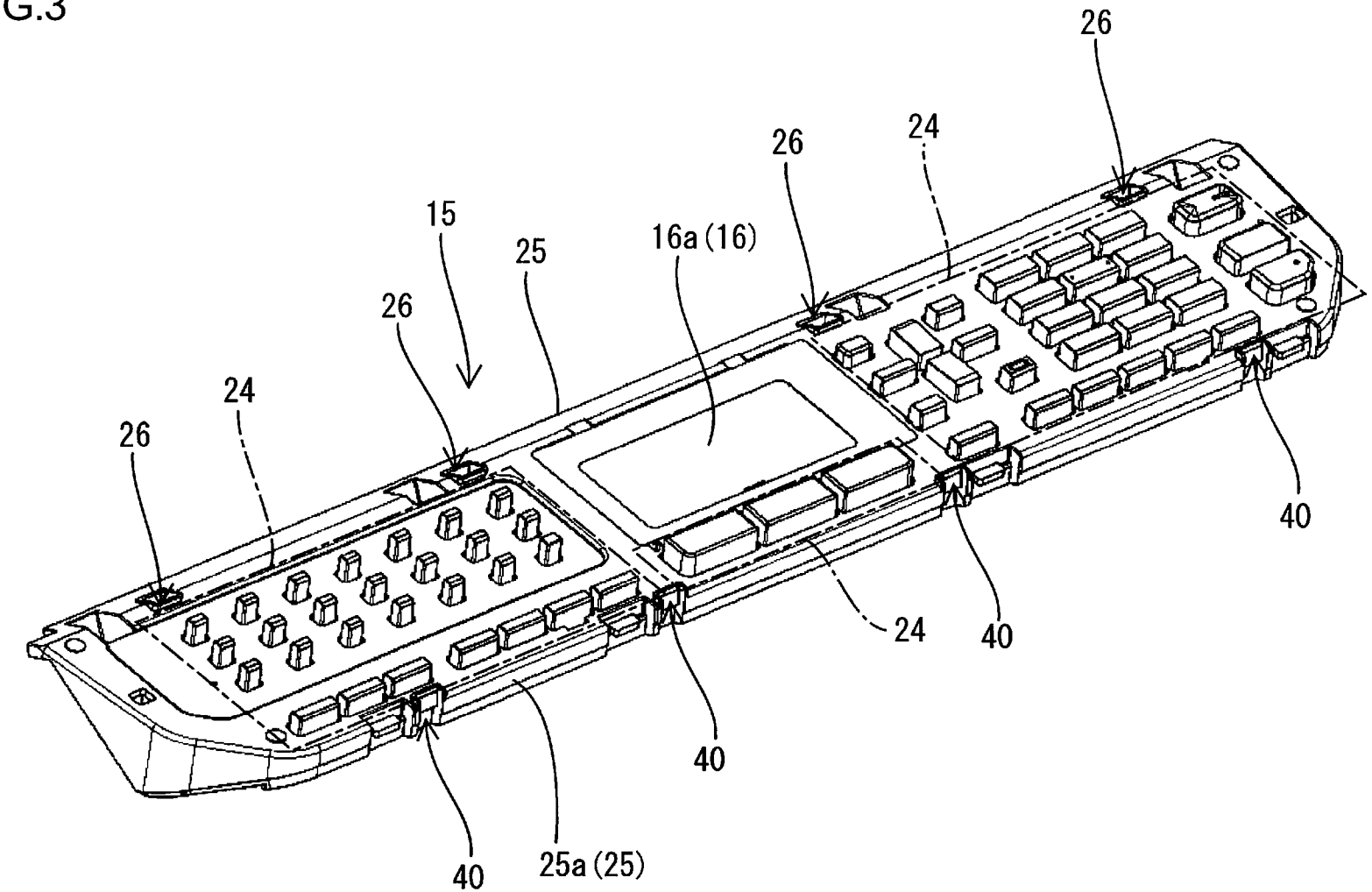
FIG. 3 is a top perspective view of an operation section.
Figure 4:
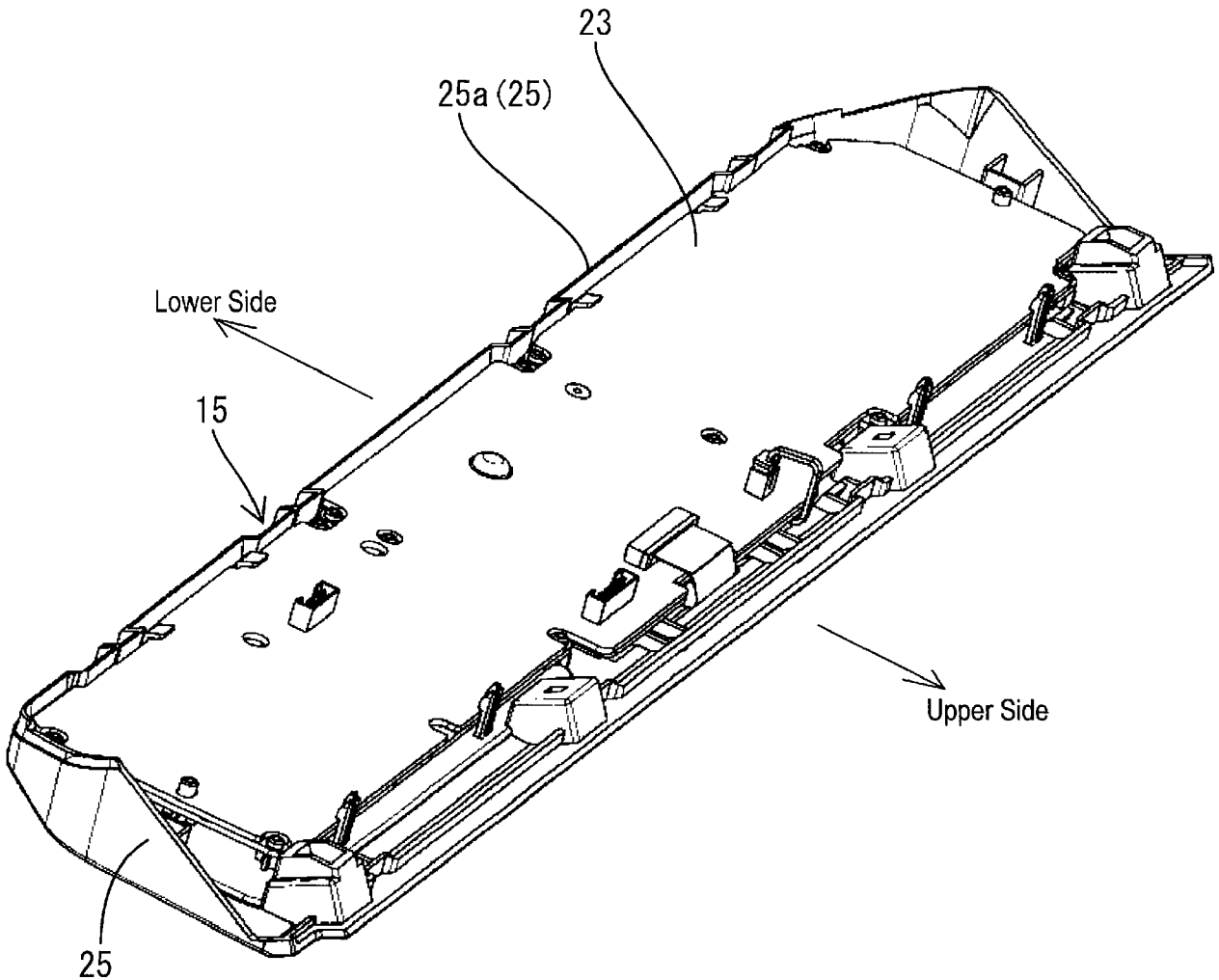
FIG. 4 is a bottom perspective view of the operation section.

FIG. 3 is a top perspective view of the operation section 15, from which the cover member 17 is detached. FIG. 4 is a bottom perspective view of the operation section 15. In the present aspect 1, the side of the operation section 15 shown in FIG. 3 is referred to as "the obverse side", while the side of the operation section 15 shown in FIG. 4 is referred to as "the reverse side".

As shown in FIG. 4, the operation section 15 includes an electric board 23 on which electrical circuits are mounted. As shown in FIG. 3, the operation section 15 includes a plurality of push-button operating switches 24, and further includes an insulating plastic member 25 (i.e., an example of an insulating member) for supporting the operating switches 24.

A user can switch the contact points on the electric board 23 on and off, using the operating switches 24. The plastic member 25 also supports the liquid crystal display 16*a*, as well as the operating switches 24.

The cover member 17 described above is detachably mounted on the operation section 15. On the cover member 17, the characters representing functions corresponding to the operating switches 24 are written in some language. The cover member 17 can be replaced with another cover member that includes character representation in another language of the user's choice, as described in detail below.

A plurality of holes 26 are formed on the plastic member 25. Hooks 30 (See FIG. 7) formed on the cover member 17 are inserted into the holes 26, so that each hook 30 engages with a claw provided inside of the hole 26. Further, a plurality of claws 40 are formed on the plastic member 25, so that hooks 31 (See FIG. 7) formed on the cover member 17 engages with the claws 40.

Referring to FIG. 4, insulating plastic walls 25*a* (i.e., an example of a wall portion) are integrally formed on the reverse side of the plastic member 25. The walls 25*a* are arranged on the outer edge portion of the plastic member 25, or specifically, arranged along its side corresponding to the lower sides of the characters written on the cover member 17, along a part of its side corresponding to the left sides of the characters, and along a part of its side corresponding to the right sides of the characters.

When the cover member 17 is detached or attached for replacement as described above, a user will touch the outer edge portion of the plastic member 25. Thereby, the static electricity on the user may be discharged to the electric board 23, resulting in damage or malfunction of the electric board 23. However, according to the present aspect 1, a long creepage distance can be maintained between the electric board 23 and the areas touched by the user, due to the insulating walls 25*a* formed on the outer edge portion of the plastic member 25.

"Creepage Distance" generally means the shortest path distance between two conductive parts, measured along the surfaces of insulators. The long creepage distance may prevent the electrostatic discharge from the hands of the user to the electric board 23 around the outer edge portion of the plastic member 25.

Thus, the probability of the electrostatic discharge to the electric board 23 can be reduced, when the cover member 17 is detached from or attached to the operation section 15. Further, due to the walls 25*a* thus formed along the outer edge portion of the plastic member 25, the long creepage distance can be achieved more effectively, compared to arranging insulators on the other areas of the operation section 15.

In the present aspect 1, the walls 25*a* on the outer edge portion of the plastic member 25 are selectively arranged on the areas, which are prone to the user's touch when the cover member 17 is detached or attached, such as the lower side and the parts of the right and left sides. However, the walls on the outer edge portion of the plastic member 25 may be arranged along its entire circumference. In this case, the probability of the electrostatic discharge to the electric board 23 can be further reduced.

Figure 5:
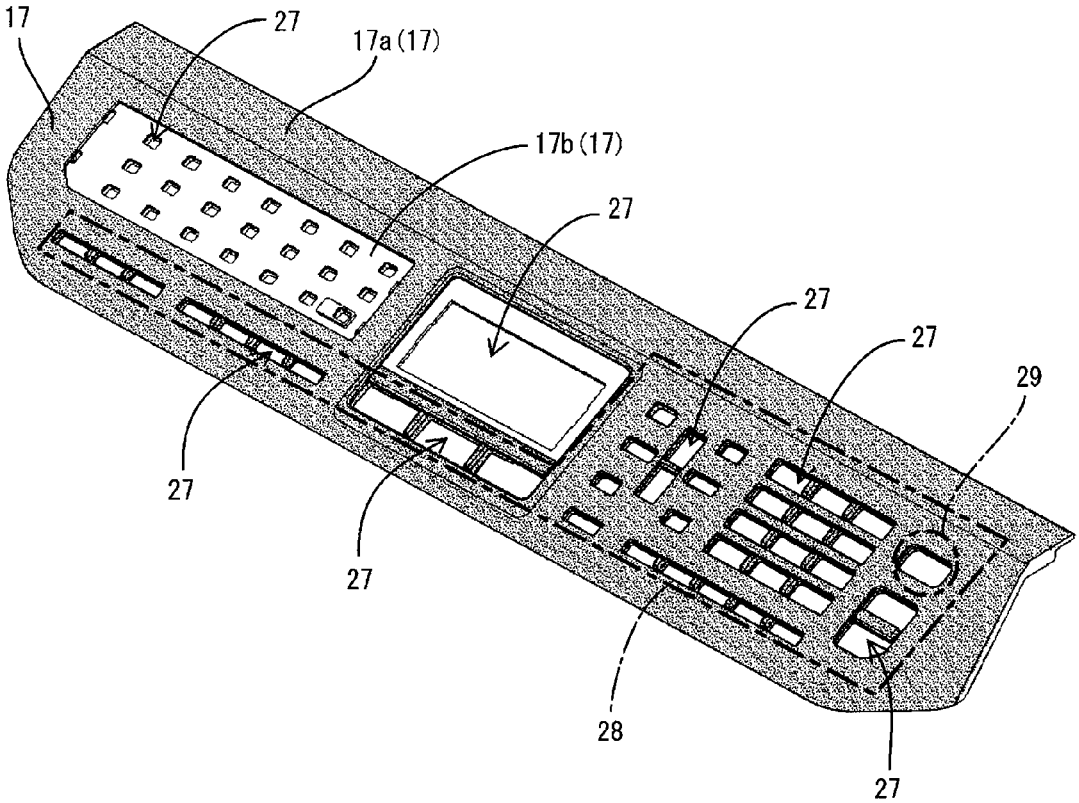
FIG. 5 is a top perspective view of a cover member.

FIG. 5 is a perspective view showing the obverse side of the cover member 17 detached from the operation section 15. The cover member 17 is a member made of synthetic resin, which is detachably mounted on the operation section 15 so as to cover the operation section 15.

Openings 27 are formed on the cover member 17 so as to correspond to the operating switches 24 and the liquid crystal display 16*a*. In FIG. 5, some of the openings 27 are designated by symbols, while symbols for the other openings 27 are omitted. The operating switches 24 and the liquid crystal display 16*a* are inserted into the openings 27, when the operation section 15 is covered with the cover member 17.

The obverse side of the cover member 17 is covered with a transparent resin film, so that the user can operate the operating switches 24 via the transparent resin film. The transparent resin film can prevent electrostatic discharge to the electric board 23 when the operation section 15 covered with the cover member 17 is used by a user.

An extension portion 17*a* is formed on the cover member 17. When the cover member 17 is attached on the operation section 15, the extension portion 17*a* extends from the outer edge portion of the cover member 17 closer to the document cover 12, so as to be covered with the document cover 12 in the closed position. The extension portion 17*a* does not overlap with the operation section 15, when the cover member 17 is attached on the operation section 15.

In the areas of the cover member 17 bounded by a dashed line 28 in FIG. 5, the characters representing functions corresponding to the operating switches 24 are written in some language, which will be hereinafter explained in detail.

Figure 6:
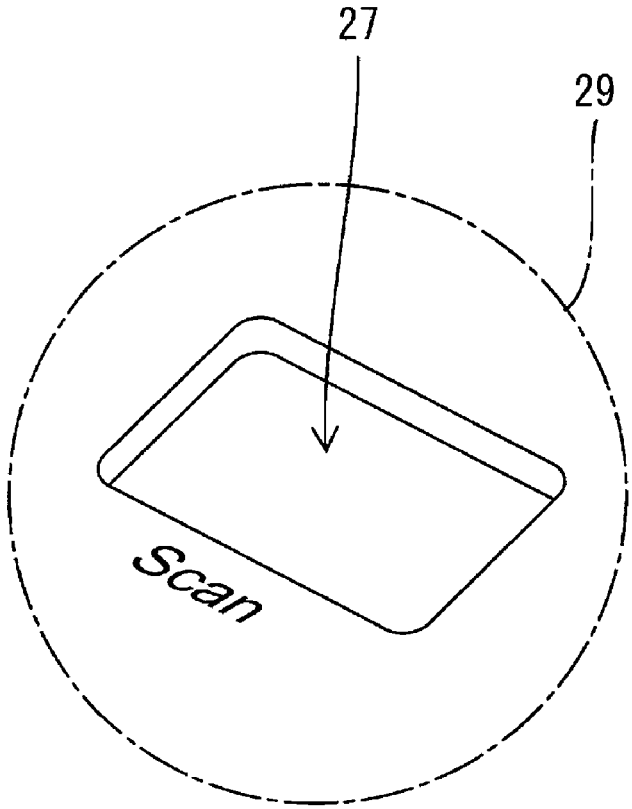
FIG. 6 is an enlarged view of a characteristic part of the cover member.

FIG. 6 is a schematic diagram that magnifies the area bounded by a dashed line 29 in FIG. 5 and shows an example of characters representing a function corresponding to one of the operating switches 24.

As shown in FIG. 6, for example, "Scan" is written in proximity to the opening 27 into which the operating switch 24 (not shown) corresponding to a scanning function is inserted. For another example, "Copy" is written in proximity to the opening 27 into which the operating switch 24 corresponding to a copy function is inserted. Thus, the characters on the cover member 17 show the user the functions corresponding to the operating switches 24.

For example, a multifunction printer 1 to be shipped to Japanese market is supplied with a cover member 17 including character representation in Japanese. A multifunction printer 1 to be shipped to U.S. market is supplied with a cover member 17 including character representation in English. A multifunction printer 1 to be shipped to Canadian market is supplied with a cover member 17 including character representation in English and a cover member 17 including character representation in French.

Therefore, a user can attach, on the operation section 15, a cover member 17 including character representation in a language of his/her choice.

Even after the cover member 17 once was attached on the operation section 15, the cover member 17 can be detached and replaced with another cover member.

As shown in FIG. 5, rectangular recesses 17*b* are formed on the cover member 17 so as to be positioned in the vicinities of the respective openings 27 into which a group of some operating switches 24 are inserted. For example, the operating switches 24 of the group are function switches to which fax numbers are assigned. A card into which the fax numbers or the like is written can be placed in each recess 17*b*.

Figure 7:
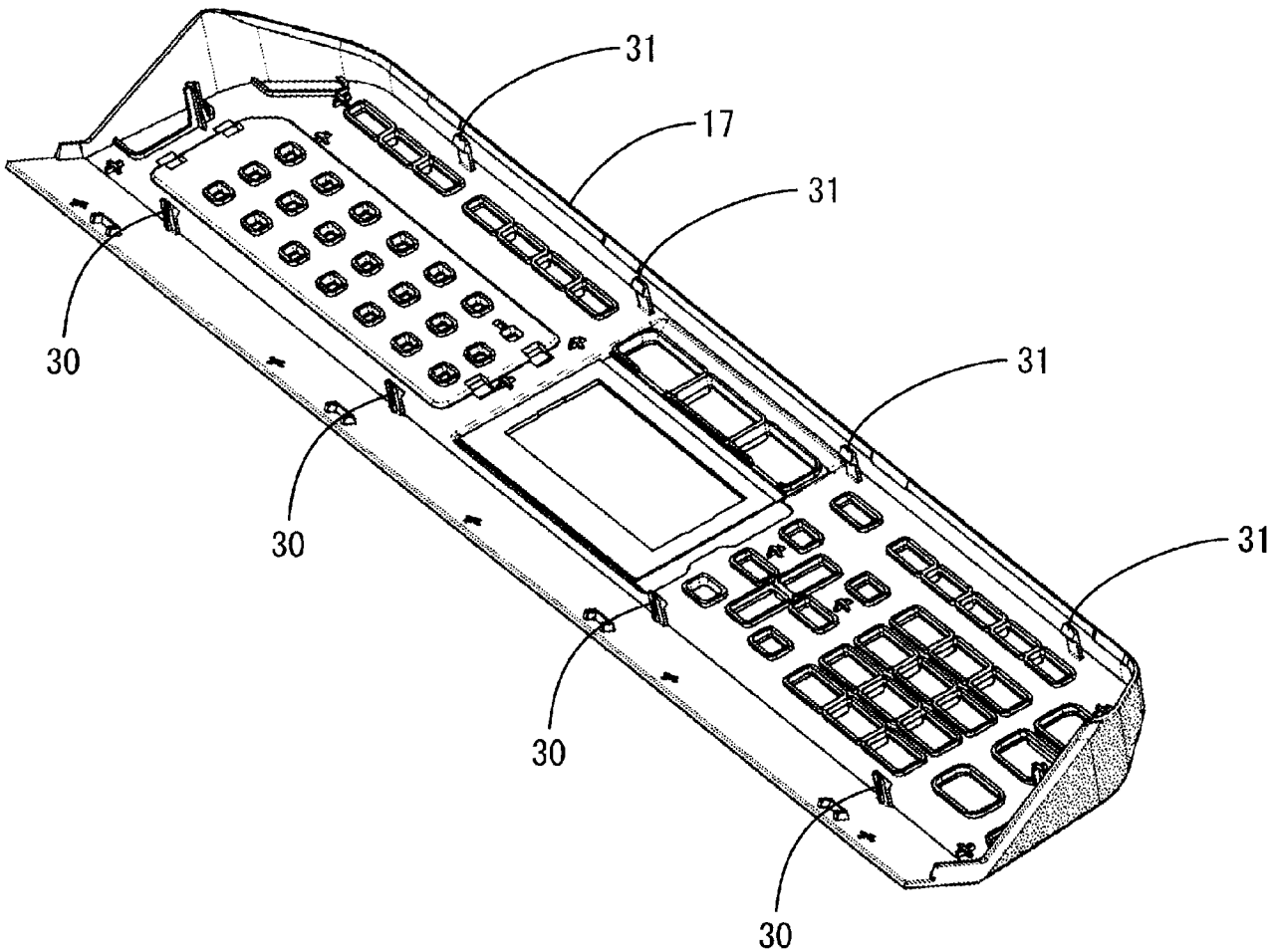
FIG. 7 is a bottom perspective view of the cover member.

FIG. 7 is a bottom perspective view of the cover member 17 when detached from the operation section 15. A plurality of hooks 30, capable of engaging with the holes 26 of the operation section 15 as described above, are formed on the reverse side of the cover member 17. Further, a plurality of hooks 31, capable of engaging with the claws 40 of the operation section 15 as described above, are formed on the reverse side of the cover member 17.

Figure 8:
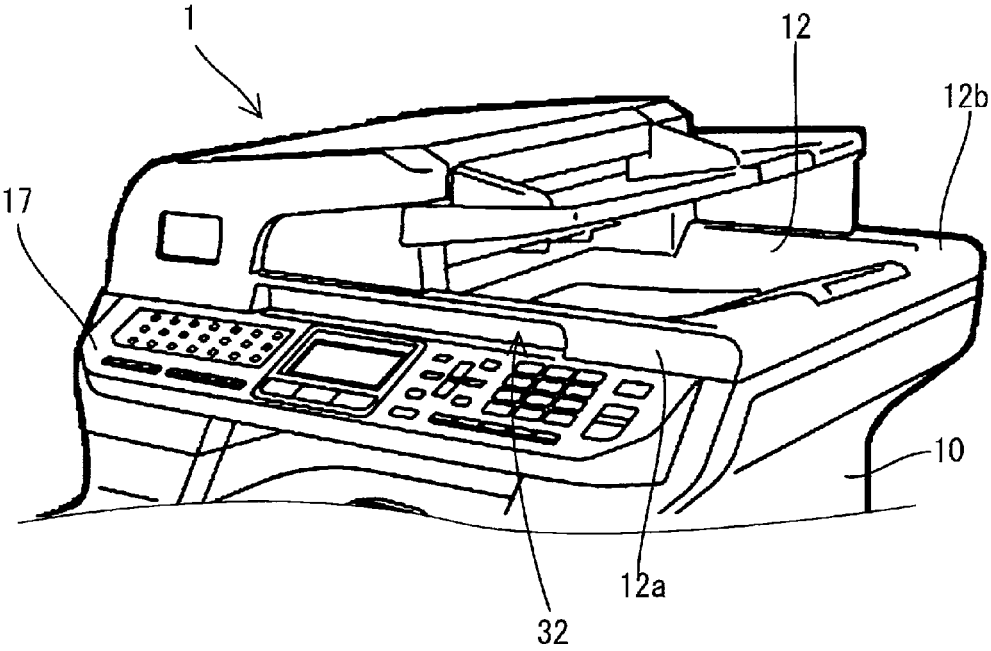
FIG. 8 is a perspective view of the upper portion of the multifunction printer.

FIG. 8 is a perspective view that magnifies and shows the upper portion of the multifunction printer 1. The document cover 12 arranged to hold a document (and is arranged in the closed or first position) is shown in FIG. 8.

A handle portion 32 is provided on the front end portion 12*a* of the document cover 12 as shown in the figure, so that a user can move the document cover 12 while handling the handle portion 32.

The rear end portion 12*b* of the document cover 12 is connected to the rear end portion of the printer unit 10 via hinges or the like. Thereby, the document cover 12 can be moved to the open or second position while rotating around its rear end portion 12*b* as the axis, so that the document rest is open.

When a user places a document on the document rest, he/she moves the document cover 12 to the second position while handling the handle portion 32.

Figure 9:
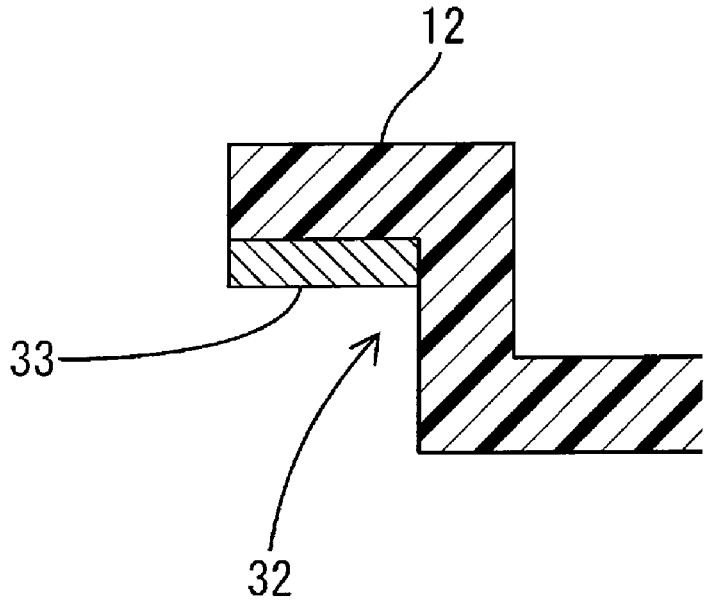
FIG. 9 is a cross-sectional view of a handle portion.
Figure 10:
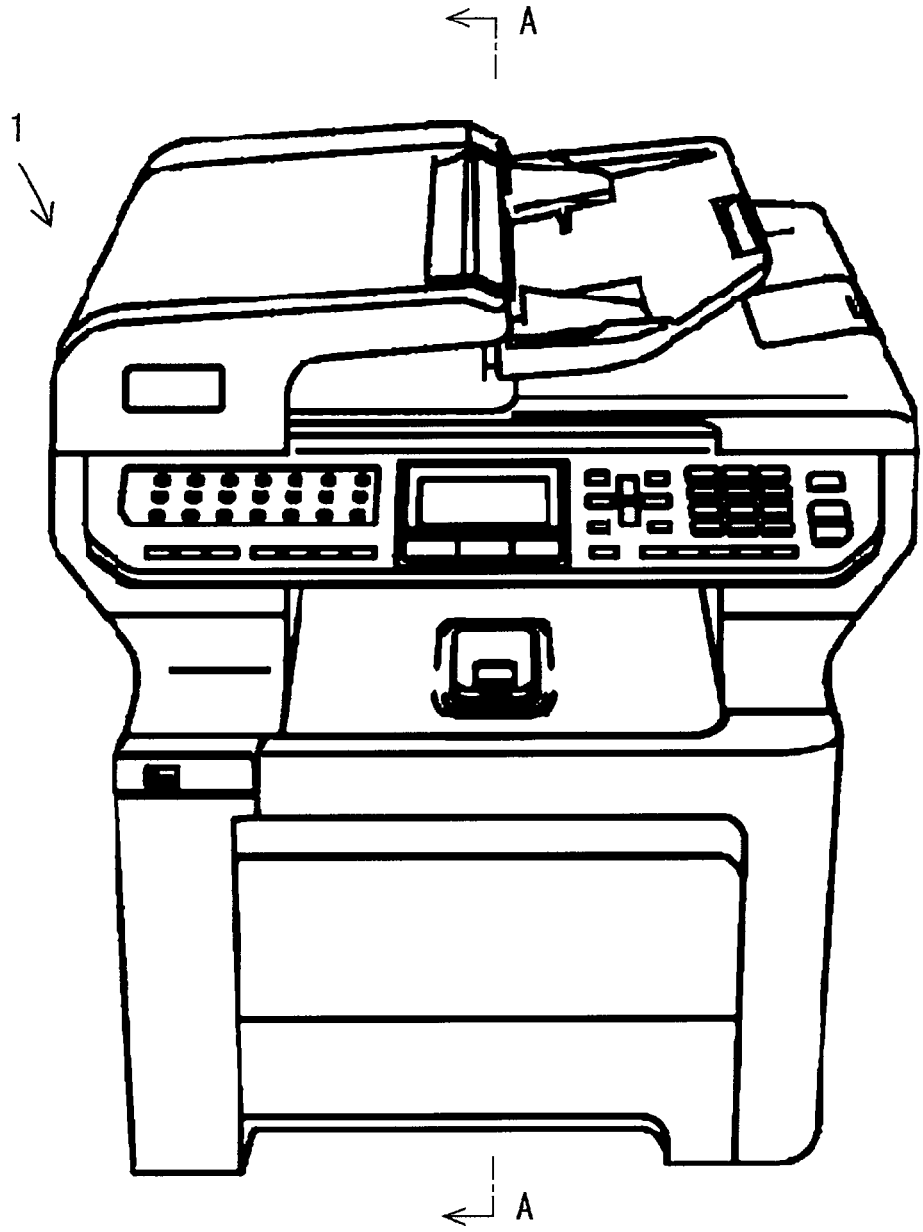
FIG. 10 is a front perspective view of the multifunction printer.

FIG. 9 is a cross-sectional view showing the handle portion 32 along the line A-A of FIG. 10. The handle portion 32 is formed of a rectangular recess that horizontally extends along the front end portion 12*a* of the document cover 12 (See FIG. 8). An antistatic sheet 33 (i.e., an example of an electrostatic eliminating device) is provided on the inner upper surface of the handle portion 32.

(Attachment and Detachment of Cover Member)

When the document cover 12 is arranged in the first position as shown in FIG. 8, the cover member 17 is partly covered with the document cover 12 as described above. Specifically, the extension portion 17*a* of the cover member 17, shown in FIG. 5, is covered with the document cover 12. In this state, a user cannot detach the cover member 17. Therefore, the document cover 12 should be opened or moved to the second position before the cover member 17 is detached.

When the user moves the cover member 17 to the second position in order to enable detachment of the cover member 17, he/she will handle the handle portion 32 of the document cover 12 while touching the antistatic sheet 33 (See FIG. 9). Thereby, the static electricity on the user can be discharged, and thereafter he/she can detach the cover member 17 from the operation section 15 without causing electrostatic discharge to the electric board 23.

Thus, according to the present aspect 1, the user should move the document cover 12 from the first position to the second position while touching the antistatic sheet 33, before he/she detaches the cover member 17. Thereby, the static electricity on the user can be discharged, and consequently the probability of the electrostatic discharge to the electric board 23 can be reduced when the cover member 17 is detached from or attached to the operation section 15.

In the multifunction printer 1 of the present aspect 1, as described above, the cover member 17 cannot be detached or attached when the document cover 12 is arranged in the first position. The cover member 17 can be detached or attached when the document cover 12 is arranged in the second position.

That is, utilizing the document cover 12 of the multifunction printer 1, the cover member 17 is switched between a detachable or attachable state and an undetachable or unattachable state, instead of providing a separate member for switching the cover member 17 between a detachable or attachable state and an undetachable or unattachable state.

Consequently, the multifunction printer 1 of the present aspect 1 has the advantages of suppression of cost increase, printer weight increase or printer size increase. That is, according to the present aspect 1, the protection of the electric board 23 from static electricity, when the cover member 17 is detached from or attached to the operation section 15, can be effectively achieved.

Further, due to the antistatic sheet 33 provided on the handle portion of the document cover 12, the protection of the electric board 23 from static electricity can be achieved more reliably, compared to providing an electrostatic eliminating device on the other areas of the multifunction printer 1.

According to the present aspect 1, a user can intuitively know, from the cover member 17 partly covered with the document cover 12, that he/she should move the document cover 12 to the second position before detachment of the cover member 17.

Further, in the present multifunction printer 1, the document cover 12 in the first position is arranged to cover the outer edge portion of the cover member 17 closer to the document cover 12. Therefore, the document cover 12 in the first position will not preclude the user's operation on the operation section 15.

In the present multifunction printer 1, the cover member 17 includes the extension portion 17*a* that can be covered with the document cover 12 in the first position. Originally, the size of the cover member 17 can be set so that the cover member 17 just covers the operation section 15.

However, according to the present aspect 1, the extension portion 17*a* of the cover member 17 is provided so that the cover member 17 can be partly covered with the document cover 12. The extension portion 17*a*, thus provided, enables switching of the cover member 17 between detachable or attachable state and undetachable or unattachable state.

Illustrative Aspect 2

Next, an illustrative aspect 2 of the present invention will be explained with reference to FIGS. 11 and 12.

Figure 11:
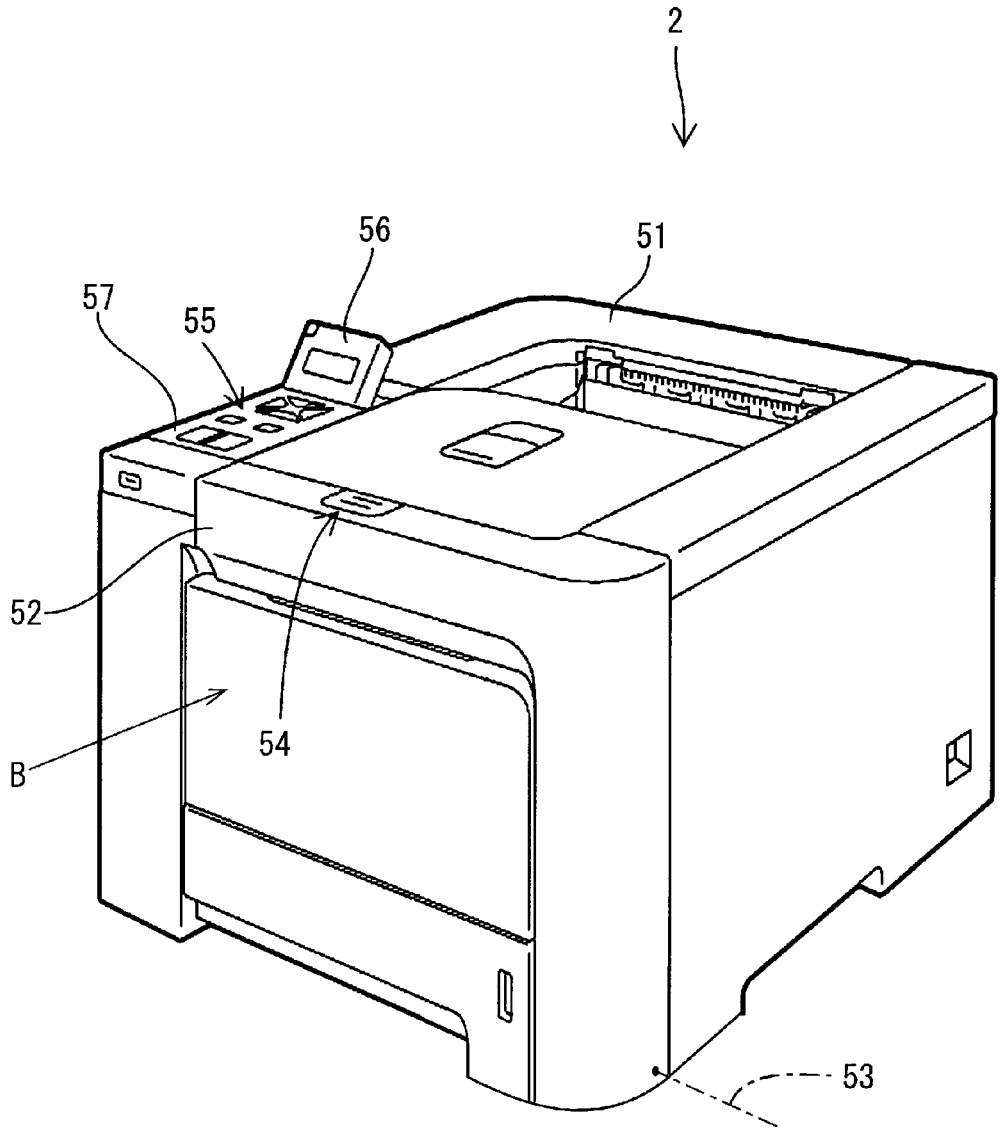
FIG. 11 is a perspective view of a printer according to an illustrative aspect 2 of the present invention.

FIG. 11 is a perspective view of a printer 2 (i.e., an example of an image input/output apparatus). In contrast to the multifunction printer 1 of the above aspect 1, the printer 2 of the present aspect 2 has a printing function, but does not have a scan function, a copy function, a fax function or the like.

The printer 2 includes a chassis 51 having an opening, a front cover 52 (i.e., an example of a door or a movable member) capable of opening and closing the opening of the chassis 51, an image forming section (i.e., an example of an image input/output section) housed in the chassis 51, an operation section 55 and the like.

The image forming section is provided for forming an image on a recording medium. The construction of the image forming section is substantially the same as the image forming section 18 of the above aspect 1, and therefore the detailed explanation will be omitted.

The opening of the chassis 51, which is hidden by the front cover 52 in FIG. 11, is provided for enabling a maintenance operation for the image forming section, such as paper jam repair or replacement of a toner cartridge or an ink cartridge.

The front cover 52 is connected to the chassis 51 via hinges or the like. Thereby, the front cover 52 can rotate around the axis shown as a dashed line 53 in FIG. 11, in the present aspect 2. The front cover 52 shown in FIG. 11 is arranged in a first position so as to close the opening of the chassis 51.

A handle portion 54 is formed on the front cover 52, so that a user can open the front cover 52 while handling the handle portion 54. The front cover 52 can be rotated to a second position to reveal the opening of the chassis 51.

When the maintenance of the image forming section should be performed, the user moves the front cover 52 to the second position while handling the handle portion 54. An antistatic sheet is provided on the handle portion 54, as in the above aspect 1.

The operation section 55 and a display section 56 are provided on the top surface of the printer 2, as shown in FIG. 11. The display section 56 includes a liquid crystal display and the like.

The operation section 55 includes an electric board (not shown), operating switches, a plastic member and the like. A user can operate the image forming section using the operating switches. The plastic member is provided for supporting the operating switches and the like.

A cover member 57 made of synthetic resin is detachably mounted on the operation section 55 so as to cover the peripheral areas of the operating switches. On the cover member 57, the characters representing functions corresponding to the operating switches are written in some language.

Figure 12:
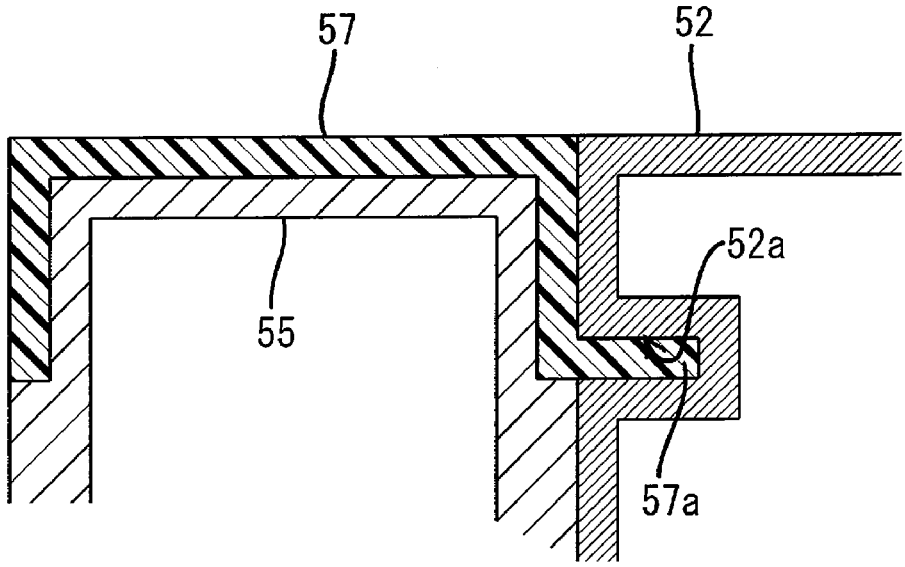
FIG. 12 is a cross-sectional view showing an operation section and a cover member.

FIG. 12 is a cross-sectional view schematically showing the operation section 55 and the cover member 57 along a plane perpendicular to the Direction B shown in FIG. 11.

The cover member 57 is arranged to cover the operation section 55. An extension portion 57*a* is formed on the cover member 57 so as to be positioned on the outer edge portion of the cover member 57 closer to the front cover 52. When the cover member 57 is attached on the operation section 15, the extension portion 57*a* can be covered with the front cover 52.

An engaging groove 52*a* is formed on the front cover 52 so as to be capable of engaging with the extension portion 57*a* of the cover member 57. The extension portion 57*a* engages with the engaging groove 52*a*, when the front cover 52 is arranged in the first position.

Thus, the extension portion 57*a* is covered with the front cover 52 in the first position, and therefore the cover member 57 cannot be detached from the operation section 55 when the front cover 52 is arranged in the first position.

The other constructions of the present aspect 2 are substantially the same as the above aspect 1.

Illustrative Aspect 3

Next, an illustrative aspect 3 of the present invention will be explained with reference to FIGS. 13 to 16.

The present aspect 3 provides an operating device, which can be used for a multifunction printer 1 of the above aspect 1 instead of the operation section 15 and the cover member 17 of the aspect 1. The operating device of the present aspect 3 includes an operation section and a cover member.

The construction of the operation section is substantially the same as the operation section 15 of the aspect 1. That is, the operation section includes an electric board, operating switches, a plastic member and the like.

Figure 13:
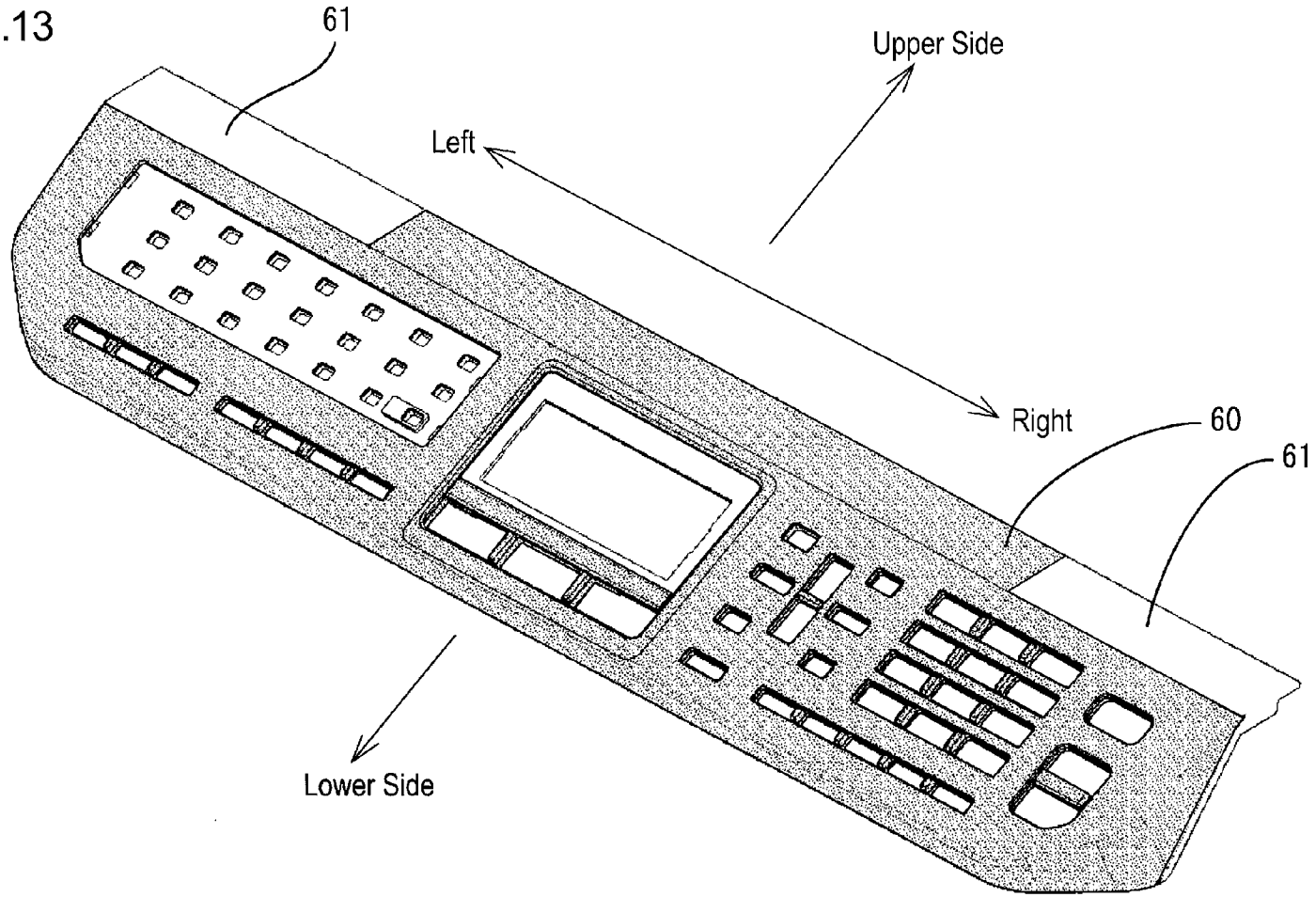
FIG. 13 is a top perspective view of a cover member according to an illustrative aspect 3 of the present invention.

FIG. 13 is a top perspective view of the cover member 60 of the present aspect 3. The construction of the obverse side of the cover member 60 is substantially the same as that of the cover member 17 of the aspect 1. However, the cover member 60 of the present aspect 3 includes first conductive members 61 on the outer edge portion of its obverse side.

Figure 14:
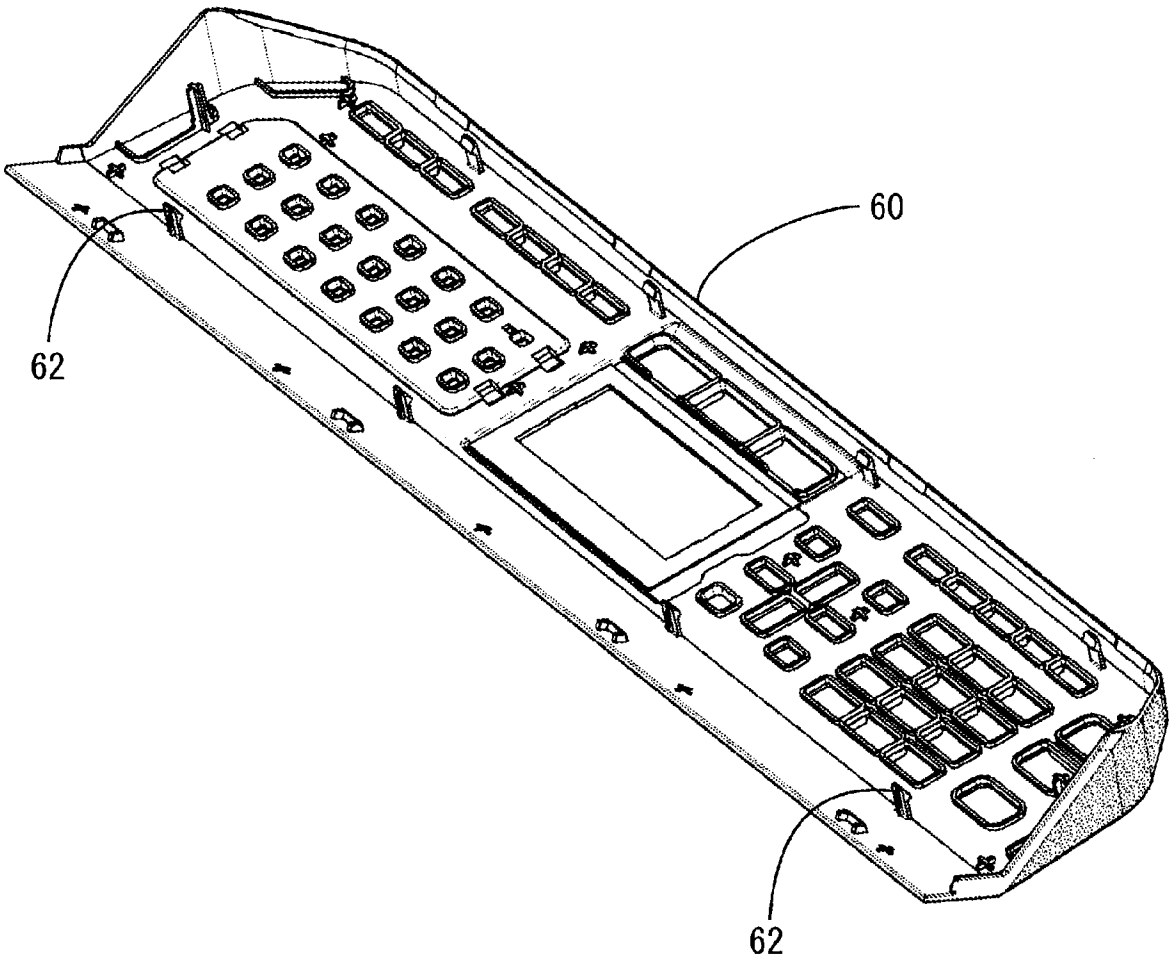
FIG. 14 is a bottom perspective view of the cover member.
Figure 15:
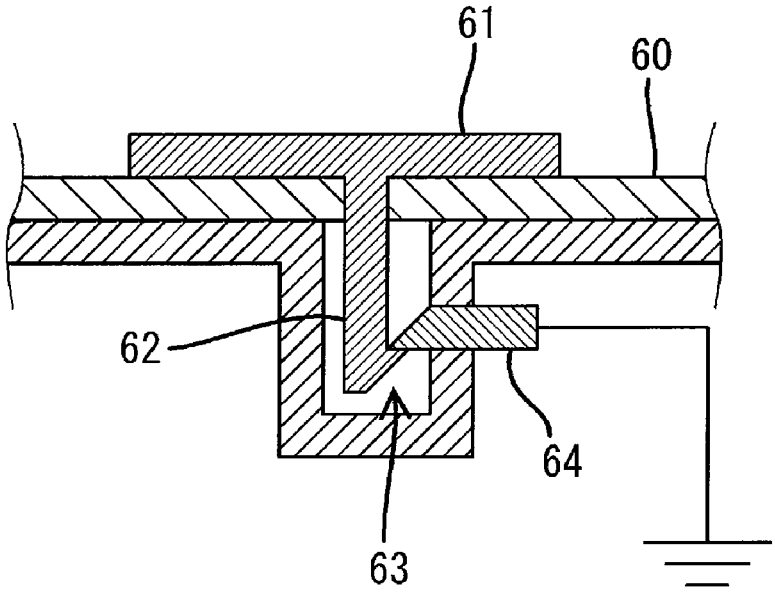
FIG. 15 is a cross-sectional view showing a first conductive member and a second conductive member.

FIG. 14 is a bottom perspective view of the cover member 60. The construction of the reverse side of the cover member 60 is substantially the same as that of the cover member 17 of the aspect 1. However, the cover member 60 of the present aspect 3 includes conductive hooks 62. Specifically, as shown in FIG. 15, for example, the hooks 62 are integrated with the respective first conductive members 61, and are inserted from the obverse side into holes formed on the cover member 60.

Figure 16:
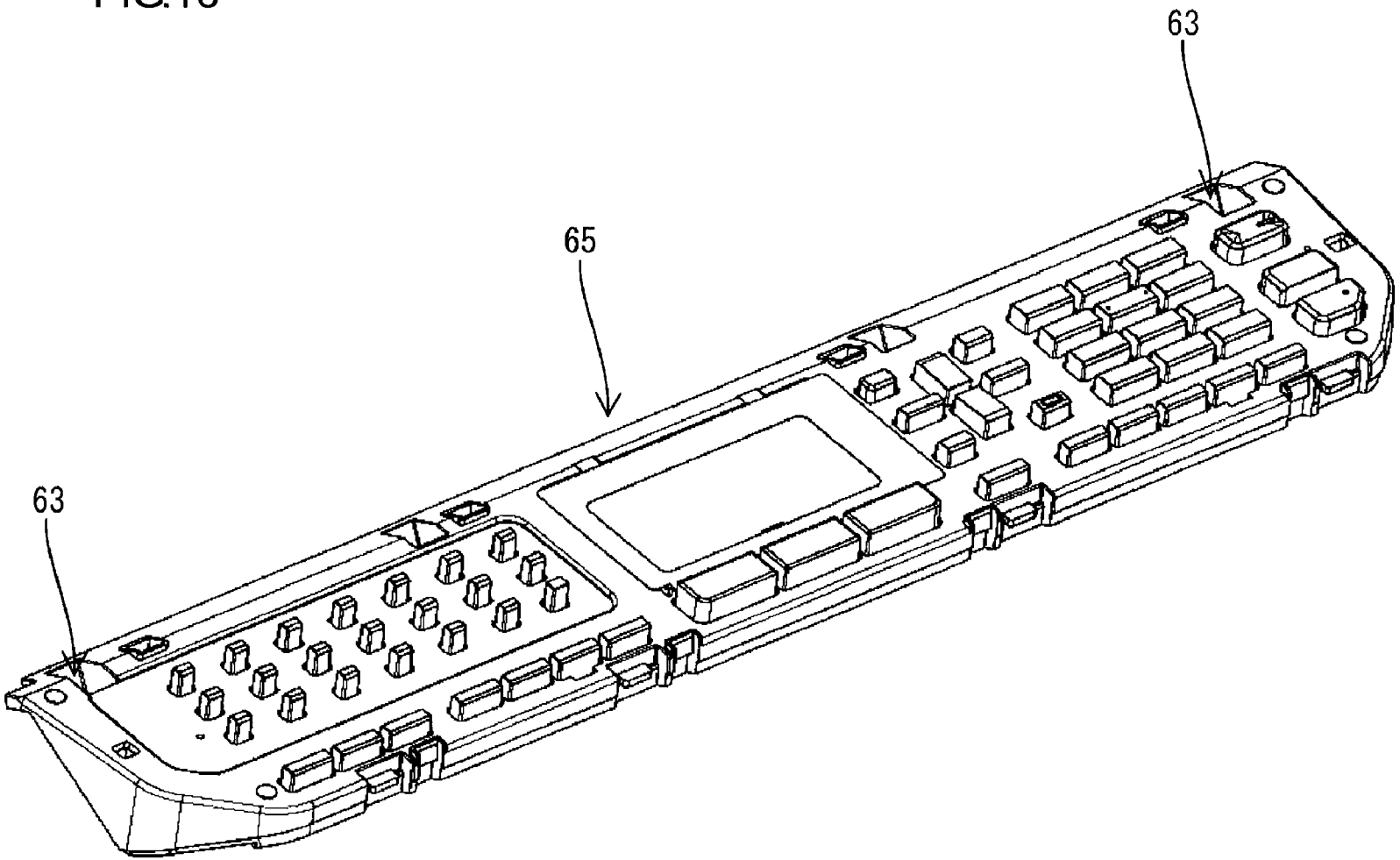
FIG. 16 is a top perspective view of an operation section.

FIG. 16 is a top perspective view of the operation section 65 of the present aspect 3. The construction of the operation section 65 is substantially the same as the operation section 15 of the aspect 1, as described above. However, as shown in FIG. 15, the operation section 65 of the present aspect 3 includes conductive claws 64 in respective holes 63, into which the hooks 62 are inserted. The claws 64 are grounded through the frame of the multifunction printer 1 and the like, for example.

In the operating device of the present aspect 3, as described above, the first conductive members 61 are provided on the outer edge portion of the obverse side of the cover member 60. At the time of replacement of the cover member 60, a user cannot detach or attach the cover member 60 without touching the outer edge portion of the cover member 60.

Therefore, the static electricity on the user can be discharged via the first conductive members 61 and the claws 64, when the cover member 60 is detached from the operation section 65.

Further, when a cover member 60 is attached on the operation section 65, the hooks 62 will first have contact with the claws 64. Therefore, also in this case, the static electricity on the user can be discharged via the first conductive members 61 and the claws 64.

Thus, according to the present aspect 3, the cover member 60 can be detached from or attached on the operation section 65, without causing electrostatic discharge to the electric board.

As described above, the first conductive members 61 are selectively arranged on the outer edge portion of the cover member 60, instead of conductive members arranged to cover the entire obverse side of the cover member 60. Thus, according to the present aspect 3, the protection of the electric board from static electricity, when the cover member 60 is detached from or attached on the operation section 65, can be effectively achieved.

The first conductive members 61 maybe provided on the outer edge portion of the reverse side of the cover member 60, instead of providing on the outer edge portion of the obverse side of the cover member 60.

A user is likely to hold a cover member 60 between his/her fingers, when he/she attaches the cover member 60 on the operation section 65. Therefore, the first conductive members 61 may be still effective, even if they are arranged on the outer edge portion of the reverse side of the cover member 60.

Illustrative Aspect 4

Next, an illustrative aspect 4 of the present invention will be explained with reference to FIG. 17.

The present aspect 4 provides another operating device, which can be used for a multifunction printer 1 of the above aspect 1. The operating device of the present aspect 4 includes an operation section and a cover member, as in the above aspect 3.

The operation section includes an electric board 23, operating switches, a plastic member 71 and the like. The constructions of the electric board 23 and the operating switches are substantially the same as those of the above aspect 3. The construction of the plastic member 71 is substantially the same as that of the aspect 3. However, the plastic member 71 of the present aspect 4 includes lightning rods as described below.

Figure 17:
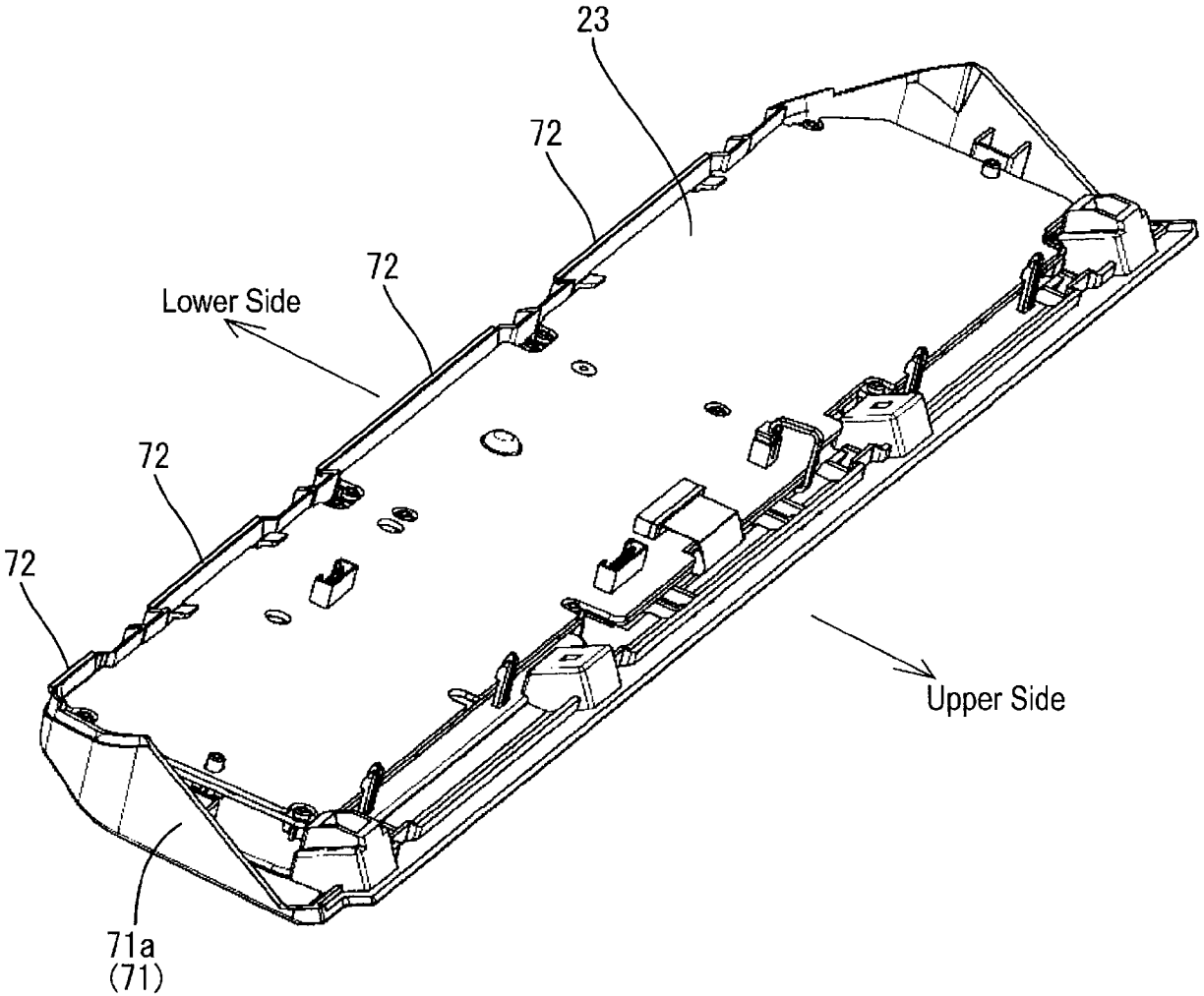
FIG. 17 is a bottom perspective view of an operation section according to an illustrative aspect 4 of the present invention.

FIG. 17 is a bottom perspective view of the plastic member 71. In order to provide a long creepage distance, walls 71*a* are formed on the reverse side of the plastic member 71 so as to be along the outer edge portion thereof, as in the above aspect 1.

A plurality of lightning rods 72 are provided on the wall 71*a* that is on the side of the plastic member 71 corresponding to the lower sides of the characters written on the cover member. The lightning rods 72 are rod-shaped conductive members, which are grounded through the frame of the multifunction printer 1 and the like.

According to the construction thus including the lightning rods 72 on the outer edge portion of the plastic member 71, the creepage distance from the hands of a user to the lightning rods 72 around the outer edge portion of the plastic member 71 is shorter than the creepage distance from the hands of the user to the electric board 23 around the outer edge portion of the plastic member 71.

Therefore, according to the present aspect 4, the static electricity on the user, which may be left even after he/she has detached the cover member, can be discharged to the lightning rods 72. Thereby, the static electricity on the user may be prevented from being discharged to the electric board 23 around the outer edge portion of the plastic member 71.

Thus, the probability of the electrostatic discharge to the electric board 23 can be reduced, when the static charge is still left on the user after he/she has detached the cover member 17 from the operation section.

Further, due to the lightning rods provided on the outer edge portion of the plastic member 71, the protection of the electric board 23 from static electricity can be achieved more effectively, compared to providing an electrostatic eliminating device on the other areas of the operating device.

In the present aspect 4, the lightning rods 72 are arranged on the lower-side outer edge portion of the plastic member 71. However, the lightning rods 72 may be circumferentially arranged along the outer edge portion of the plastic member 71.

In the present aspect 4, the plastic member 71 having the walls 71*a* is shown for illustrative purposes. However, lightning rods 72 may be provided on a plastic member that does not include walls 71*a*.

In the present aspect 4, the lightning rods 72 are grounded through the frame of the multifunction printer 1 and the like. However, the lightning rods 72 may be grounded through jumper wires and the like, which are mounted on the electric board 23 so as to bypass the patterns formed on the electric board 23.

Other Illustrative Aspects

The present invention is not limited to the illustrative aspects explained in the above description made with reference to the drawings. The following illustrative aspects may be included in the technical scope of the present invention, for example.

(1) In the above aspect 1, a multifunction printer 1 having both a scanner unit 11 for scanning an image and an image forming section 18 for forming an image on a recording medium is shown as an image input/output apparatus, for illustrative purposes.

However, the image input/output apparatus may include solely a scanner unit 11. That is, the present invention can be applied to an image input/output apparatus that can input an image but cannot output an image.

(2) In the above aspect 2, a printer 2 capable of outputting or forming an image on a recording medium is shown as an image input/output apparatus, for illustrative purposes.

However, the present invention can be applied to an image input/output apparatus that can output or fax a document image via communication lines such as public telephone lines.

(3) In the above aspects 1 and 2, an antistatic sheet is shown as an electrostatic eliminating device, for illustrative purposes.

However, the electrostatic eliminating device may be formed of any member that can eliminate the static electricity on a user when he/she opens the document cover 12 or the front cover 52. For example, a lightning rod may be provided on the handle portion 32 or 54, instead. Alternatively, both an antistatic sheet and a lightning rod may be provided on the handle portion 32.

What is claimed is:

1. An image input/output apparatus comprising:

an image input/output section configured to perform at least one of an image input operation and an image output operation, said image input/output section including a movable member capable of being moved between a first position and a second position;

an operation section configured to enable an operation of said image input/output section, said operation section including an electric board;

a cover member detachably mounted to said operation section so as to cover said operation section; and an electrostatic eliminating device arranged on said movable member;

wherein said cover member is undetachable and unattachable when said movable member is in said first position, and is detachable and attachable when said movable member is in said second position.

2. An image input/output apparatus as in claim 1, wherein:

said movable member includes a handle portion; and said electrostatic eliminating device is arranged on said handle portion.

3. An image input/output apparatus as in claim 1, wherein:

said image input/output section includes a scanner unit configured to scan a document placed on a document rest, and further includes a document cover as said movable member that is capable of covering said document rest; and said document rest is covered by said document cover when said document cover is in said first position, and is uncovered when said document cover is in said second position.

4. An image input/output apparatus as in claim 1, wherein:

said image input/output section includes a chassis having an opening, and further includes a door as said movable member that is capable of opening and closing said opening of said chassis; and said opening of said chassis is closed when said door is in said first position, and is open when said door is in said second position.

5. An image input/output apparatus as in claim 1, wherein said movable member covers at least a part of said cover member when said movable member is in said first position.

6. An image input/output apparatus as in claim 5, wherein said movable member covers an outer edge portion of said cover member closer to said movable member when said movable member is in said first position.

7. An image input/output apparatus as in claim 6, wherein said cover member includes an extension portion that is covered by said movable member when said movable member is in said first position.

8. An image input/output apparatus as in claim 1, wherein said electrostatic eliminating device includes at least one of an antistatic sheet and a lightning rod.

9. An image input/output apparatus as in claim 1, further comprising:

a first conductive member arranged on an outer edge portion of said cover member, said first conductive member being positioned on a part of said cover member that first has contact with said operation section when said cover member is mounted to said operation section; and a second conductive member arranged on said operation section, said second conductive member being positioned on a part of said operation section that first has contact with said first conductive member when said cover member is mounted to said operation section;

wherein said cover member has an insulation property.

10. An image input/output apparatus as in claim 1, wherein an operation section has an insulating member configured to support said electric board, and said cover member has an insulation property;

said image input/output apparatus further comprising an electrostatic eliminating device arranged on an outer edge portion of said insulating member.

11. An image input/output apparatus as in claim 10, wherein said electrostatic eliminating device includes a lightning rod.

12. An image input/output apparatus as in claim 1, wherein said operation section has an insulating member configured to support said electric board;

said image input/output apparatus comprising a wall portion arranged on an outer edge portion of said insulating member so as to increase a creepage distance between said cover member and said electric board.

* * * * *